US005669528A

United States Patent [19]

Romero et al.

[11] Patent Number: 5,669,528

[45] Date of Patent: Sep. 23, 1997

[54] VACUUM STORAGE AND DISPENSING CONTAINER

[75] Inventors: Johnie Romero, Greenwell Springs, La.; Andrew R. Weber, Chatham, N.J.; Douglas B. Leeds; Helene Paulson, both of New York, N.Y.; Arthur T. Sempliner, Douglaston, N.Y.

[73] Assignee: Community Coffee Company, Inc., Baton Rouge, La.

[21] Appl. No.: 425,932

[22] Filed: Apr. 20, 1995

[51] Int. Cl.[6] ..... B67D 5/08

[52] U.S. Cl. ..... 222/53; 222/129; 222/152; 222/185.1; 222/444

[58] Field of Search ..... 222/53, 129, 152, 222/185.1, 444; 99/275, 292

[56] References Cited

U.S. PATENT DOCUMENTS

| | | | |
|---|---|---|---|
| 1,936,857 | 11/1933 | Reisdorf | 221/146 |
| 2,110,518 | 3/1938 | Becker | 99/236 |
| 2,662,664 | 12/1953 | Decker | 222/53 |
| 4,016,999 | 4/1977 | Denzer | 220/231 |
| 4,218,967 | 8/1980 | Batchelor | 99/472 |
| 4,360,129 | 11/1982 | Brokaw et al. | 222/146 H |
| 4,362,095 | 12/1982 | Wheatley | 99/472 |
| 4,850,304 | 7/1989 | Nicholson | 222/129 X |
| 4,936,833 | 6/1990 | Sams | 222/391 X |
| 5,050,778 | 9/1991 | Corrado et al. | 222/152 |
| 5,199,472 | 4/1993 | Rollison | 222/152 X |
| 5,244,019 | 9/1993 | Derty | 222/152 X |
| 5,437,393 | 8/1995 | Blicher et al. | 222/185.1 X |

OTHER PUBLICATIONS

Jan Thomas, "Bean Bins and Display Cases: New Ideas and an Emphasis on Customization," pp. 20–24, Jan. 1995, *World Coffee & Tea.*

Advertisement for Brothers Gourmet Coffee device.

*Primary Examiner*—Joseph Kaufman

*Attorney, Agent, or Firm*—N. Elton Dry; J. Mark Gilbreth; Robert W. Strozier

[57] ABSTRACT

There is disclosed a vacuum storage and dispensing container for use with perishable items, particularly food products, and more particularly for use with roasted whole-bean coffee in any retailing application, to extend the shelf life of the perishable item for several months. The invention comprises a storage and dispensing container having a cylinder with a top end and a bottom end. An upper enclosure is attached to the top end and a lower enclosure to the bottom end. There is provided a system for releasing and creating a vacuum in the cylinder, upper enclosure, and lower enclosure for maintaining freshness of the perishable item. In another aspect, there is disclosed a merchandising unit for storing and dispensing perishables comprising a plurality of storage and dispensing containers. Each container includes a cylinder having a top end and a bottom end. An air-tight upper enclosure is attached to the top end and an air-tight lower enclosure to the bottom end. There is also provided a system for releasing and creating a negative pressure within the containers.

1 Claim, 9 Drawing Sheets

VACUUM STORAGE AND DISPENSING CONTAINER

FIELD OF THE INVENTION

This invention generally relates to a vacuum storage and dispensing container for use with perishable items, particularly food products, and more particularly for use with roasted whole-bean coffee, to extend the shelf life of the perishable item for several months.

BACKGROUND OF THE INVENTION

Preservation of food is accomplished by controlling and, where possible, destroying the agents of food spoilage. Food spoilage is any organoleptic change—that is, any tactile, visual, olfactory, or flavor change—that the consumer considers to be an unacceptable departure from the normal state. The agents of food spoilage are present in abundance, not only within the food, but in the environments where foods are grown, harvested, processed, and stored. They can include microorganisms such as bacteria and mold or a wide variety of chemical and physical factors. Of particular importance is oxygen and moisture, which can degrade some food products in a short period of time. A number of preservation techniques, including canning, dehydration, refrigeration, chemical additives, and irradiation, have been devised to stop the various kinds of food spoilage.

Ground coffee is one food product, for example, that is vacuum packed in order to maintain freshness for delivery to the consumer. Obviously, however, the coffee begins to loose freshness the moment the container is opened and the vacuum lost to the surrounding atmosphere, which is normally humid to a substantial degree. Because of this, consumers are demanding whole-bean coffee that they can grind in small portions just prior to brewing. Nevertheless, the delivery of roasted whole-bean coffee to consumers in a retail setting is plagued with similar difficulties, for whole-bean coffee is susceptible to gradual, but continuous, permeation of oxygen and moisture leading to staleness of the product.

Roasted whole-bean coffee is now sold in what is commonly known in the industry as atmospheric storage bins. They can include storage bins from which a customer removes coffee beans with the aid of a scoop (which can present sanitation problems), storage bins that offer a free-flow, spout-type mechanism in the bottom operated by a lever, or storage bins with a portion control device designed to dispense a predetermined amount of coffee beans. In general, these coffee storage bins are designed to accomplish one basic objective: to make it easy to dispense the product.

Typically, a grocery store customer selects the whole-bean coffee from these storage bins, dispenses the coffee beans into a coffee grinder, grinds the coffee, and then takes the ground coffee beans home for his or her personal use. Unfortunately, these atmospheric storage bins allow the entry of air and moisture. When exposed to these elements, the roasted coffee beans quickly surrender their rich aroma, freshness, and distinctive taste. These containers can also be opened by the customer and foreign objects inserted to contaminate the product. As such, the consuming public is not always presented with fresh, pure coffee beans.

A general object of the invention is to provide a tamper proof container designed so that perishable items, such as coffee beans or other food products, may be retained therein, free from interaction with air and humidity, to preserve their freshness.

SUMMARY OF THE INVENTION

The present invention relates to a vertical storage cylinder which is filled with a perishable item or food product, such as whole-bean coffee. The cylinder is maintained under a vacuum by a vacuum pump which is connected to the cylinder by vacuum lines. After selecting the particular perishable item desired, the consumer turns a handle or knob which opens a dispensing door. The handle, which is attached to a rotary shaft, causes the shaft to rotate thus turning a cam lobe. The cam lobe moves a valve, which also opens the vacuum, allowing air to enter the cylinder, and allowing the vacuum to be released. The perishable items, such as coffee beans, flow out through the dispensing door into the customer's bag. With the assistance of a helper spring, the rotary shaft and dispensing door are then returned to a closed position. A sensor or pressure switch notes the lack of vacuum and triggers the vacuum pump such that the vacuum conditions are reestablished to maintain product freshness.

In one aspect, the invention comprises means for storing, under reduced atmospheric pressure, a product to be dispensed; means for removing a portion of the product from the storing means; means for creating and maintaining a pressure differential within the storing means; and means for temporarily eliminating the pressure differential during the removal or restocking of the portion of the product. The invention may further comprise means for detecting and recreating the pressure differential within the storing means. The invention may further comprise means for selectively inhibiting the operation of the removing means.

In another aspect, the invention comprises a storage and dispensing container having a cylinder with a top end and a bottom end. An upper enclosure is attached to the top end and a lower enclosure to the bottom end. There is provided means for releasing and creating a vacuum in the cylinder, upper enclosure, and lower enclosure for maintaining freshness of the perishable item. In yet another aspect, there is disclosed a merchandising unit for storing and dispensing perishables comprising a plurality of storage and dispensing containers. Each container includes a cylinder having a top end and a bottom end. An air-fight upper enclosure is attached to the top end and an air-tight lower enclosure to the bottom end. There is also provided means for releasing and creating a pressure change within the containers.

The foregoing has outlined rather broadly the features and technical advantages of the present invention so that the detailed description of the invention that follows may be better understood. Additional features and advantages of the invention will be described hereinafter which form the subject of the claims of the invention. It should be appreciated by those skilled in the art that the conception and the specific embodiment disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

This invention generally relates to a vacuum storage and dispensing container for use with perishable items, particularly food products, and more particularly for use with roasted whole-bean coffee, to extend the shelf life of the perishable item for several months.

Figure 1:
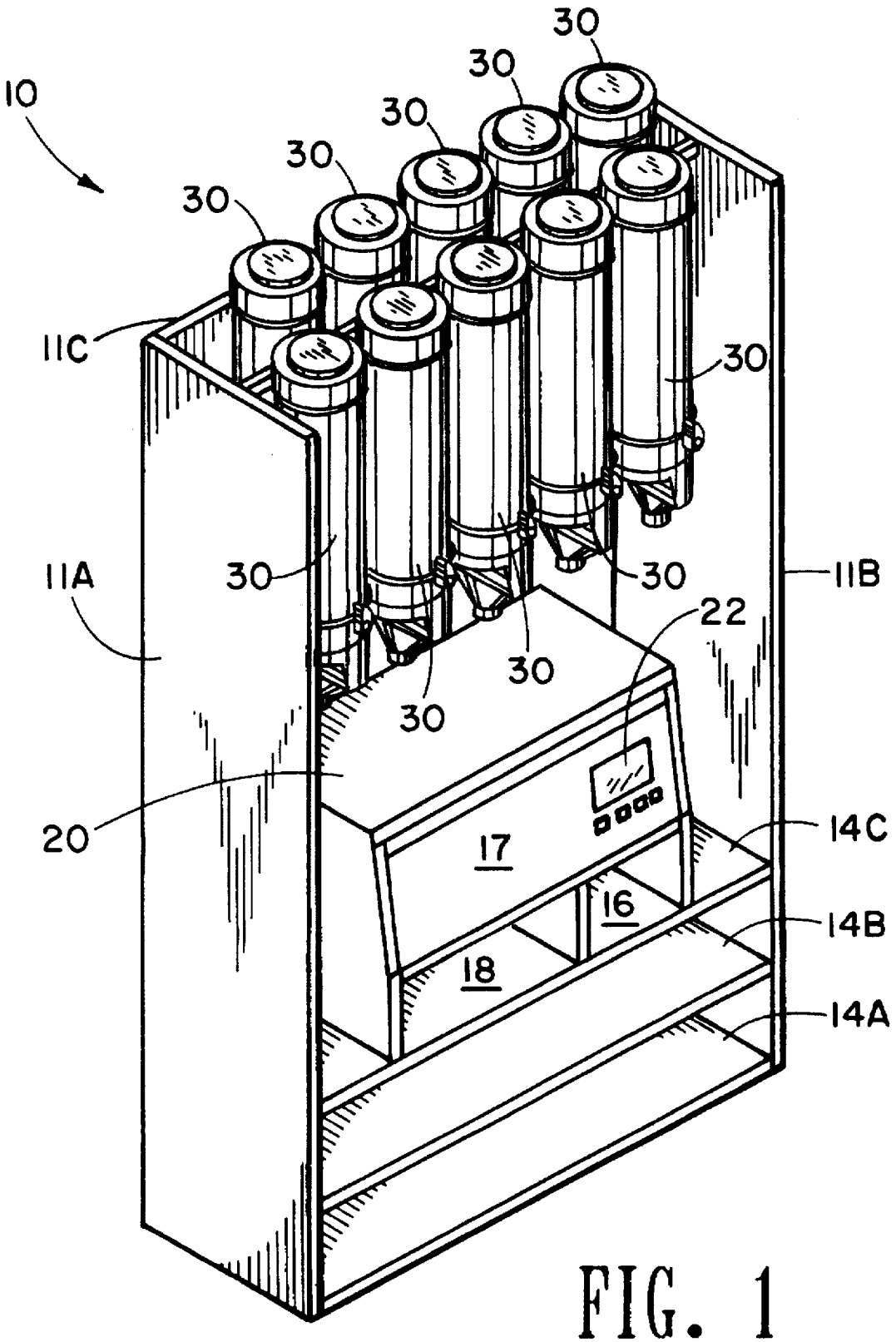
FIG. 1 is a pictorial view of a merchandising unit illustrating the basic components of an apparatus of the present invention.

There is shown in FIG. 1 a pictorial view of a merchandising unit 10 illustrating the basic components of the apparatus of the present invention. The merchandising unit 10, which has a left side wall 11A, a right side wall 11B, and a rear wall 11C, is preferably made of particle board with a laminated finish, such as wood, Formica, or other high pressure laminate. The merchandising unit 10 is from about 4 to about 10 foot tall, from about 2 to about 8 foot wide, and from about ½ to about 2 foot deep.

Near the bottom of the merchandising unit 10, there are a number of shelves 14A, 14B, and 14C. Packages of ground and whole-bean coffee may be displayed for sale to the consumer and placed on top of the shelves 14A and 14B. The packages may be held in storage trays that have a spring to keep the packages near the front of the unit for proper presentation. Shelve 14C supports two coffee grinders 12A and 12B (see FIG. 2), and a utility cabinet 20. The coffee grinders are standard off-the-shelf models, one of which is used to grind unflavored coffee beans and the other for flavored coffee beans. The utility cabinet has three compartments 16, 17 and 18. Compartment 16 may hold smaller packages of ground and whole-bean coffee presented in similar spring pusher trays. Compartment 17, which has a hinged door, stores a vacuum pump and associated mechanical devices to be discussed later. Compartment 18 may be used to store empty bags in which the customer may add coffee beans or ground coffee.

Near the top of the merchandising unit 10 is a number of vacuum storage and dispensing containers 30 filled with roasted whole-bean coffee. To aid the consumer in his or her selection of coffee beans, the utility cabinet 20 may have a consumer interactive component 22. A spill tray (not shown) may be placed on top of the utility cabinet 20 to catch wayward coffee beans that fall to fall within a customer's bag when released from the containers above.

The merchandising unit, shelves, cabinet, and compartments may be manufactured from a variety of materials, such as wood, steel, aluminum, plastic, and the like. Further, the merchandising unit could be decorated and trimmed in many ways with the use of materials such as chrome, brass, wood fascias, wood grain laminates, or with advertising materials such as banners and displays. If desired, the merchandising unit could have lighting mounted on the walls or shelves.

Figure 2:
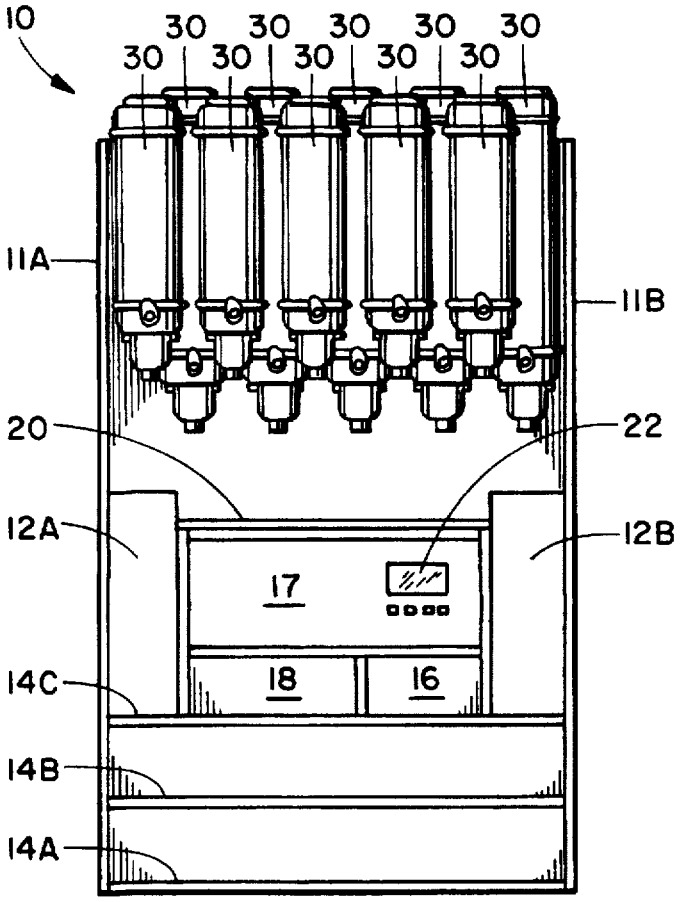
FIG. 2 is a from view of the merchandising unit depicted in FIG. 1.
Figure 3:
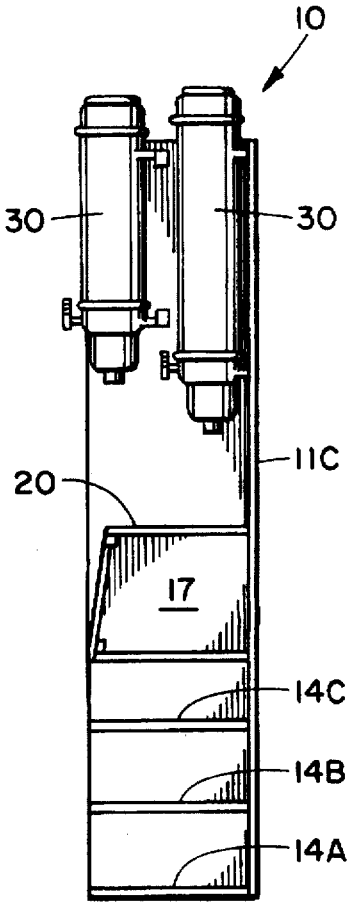
FIG. 3 is a cross-sectional side view of the merchandising unit depicted in FIG. 1.
Figure 4:
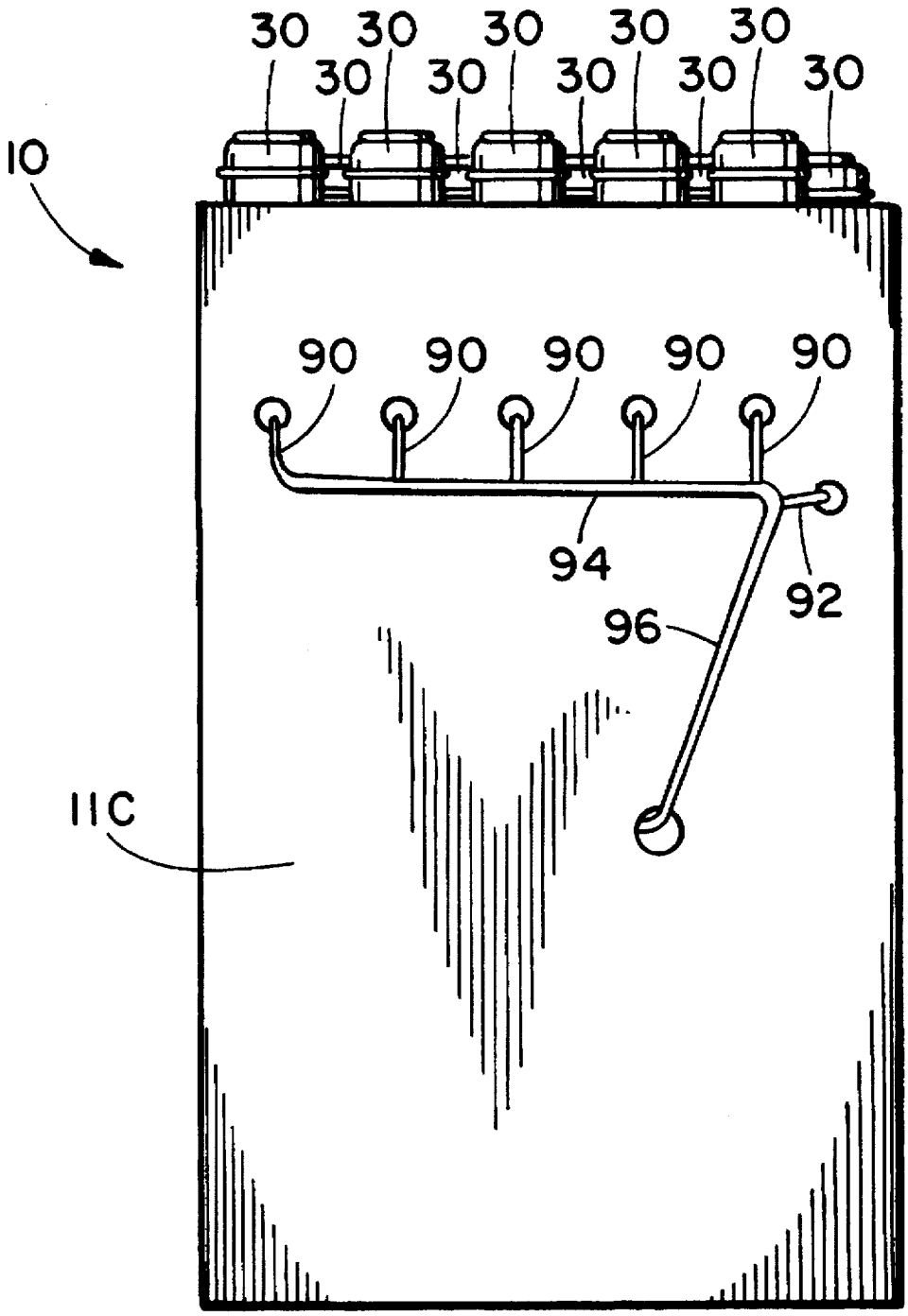
FIG. 4 is a rear view of the merchandising unit depicted in FIG. 1.

As timber seen in FIGS. 2–4, the merchandising unit 10 has a plurality of storage and dispensing containers 30. Each container may be filled with a different type of coffee bean, such as Brazilian coffee beans or Columbian coffee beans, or flavored coffee beans, in enough of a variety to pique the interest of the consumer. Since there is one type of bean per container 30, the products remain separated and can be dispensed separately. In the preferred embodiment, there is shown 10 containers, in two rows of 5 containers each, within a 4 foot wide merchandising unit 10. The number of containers, however, is not limited, for the aspects of the present invention are as useful for one container as for hundreds of containers—the merchandising unit is very flexible in design. For example, a single container for home use, as well as a double modular unit having 20 containers for industrial use, could be designed. FIG. 4 also shows the arrangement of the vacuum lines, to be discussed below, exiting from the rear wall 11C of the merchandising unit 10.

Figure 5:
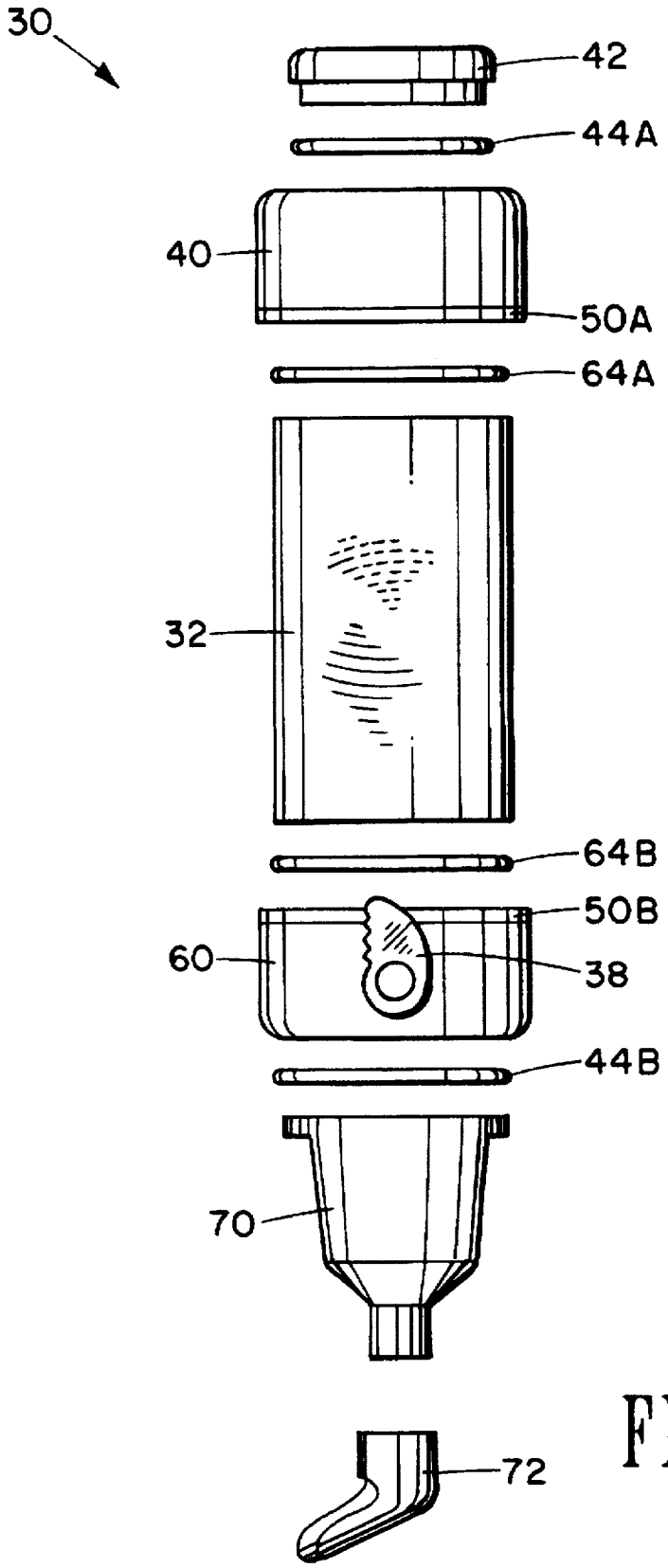
FIG. 5 is an exploded from view of a container of the present invention.
Figure 6:
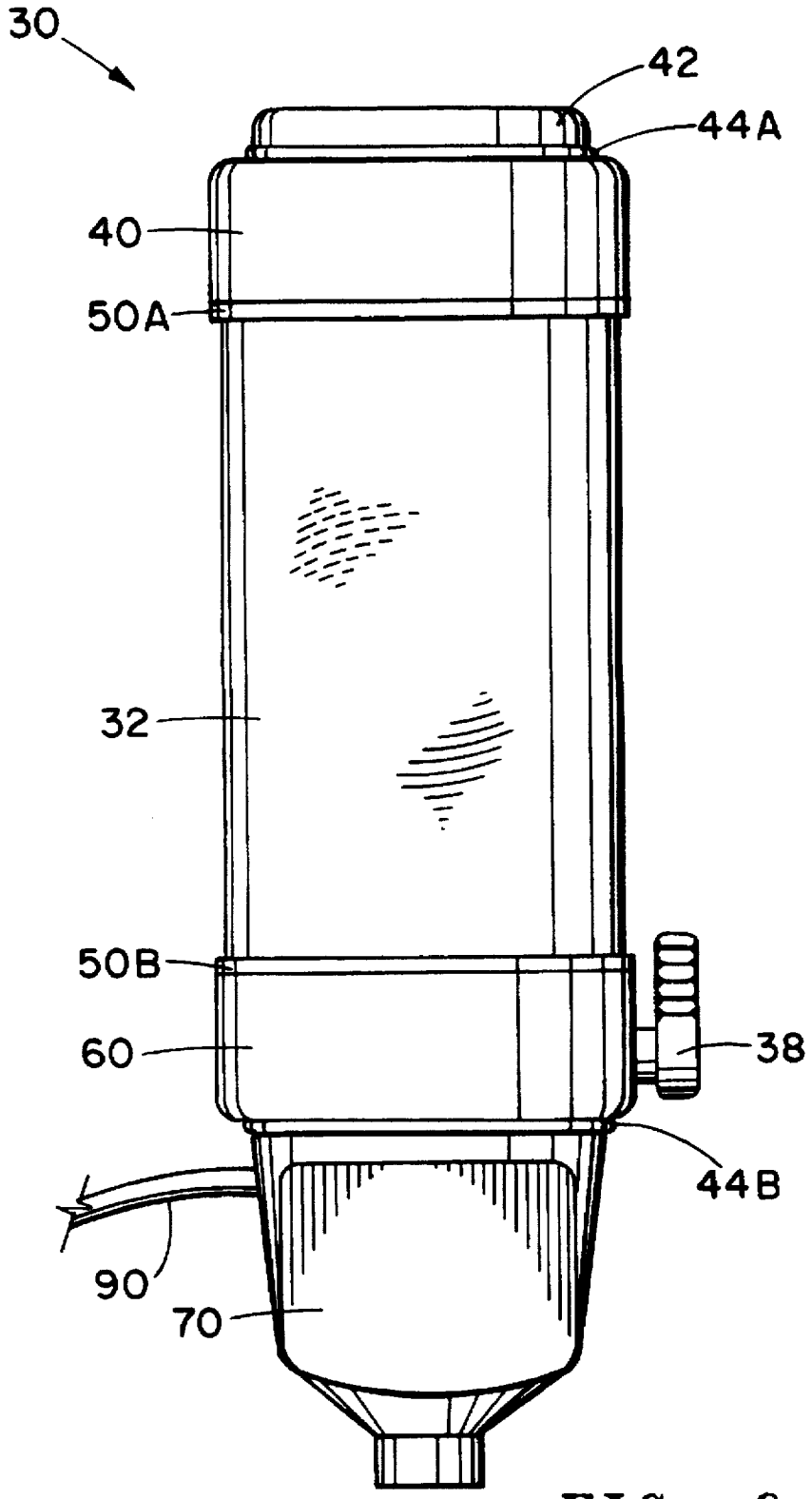
FIG. 6 is a left side view of the container depicted in FIG. 5.

Turning now to FIGS. 5 and 6, there is shown an exploded front view and a left side view of a container of the present invention. To begin, the invention comprises a means for storing, under reduced atmospheric pressure, a product to be dispensed. For example, the storage and dispensing container 30 comprises a transparent, hollow, elongated cylinder 32, an upper enclosure 40, and a lower enclosure 60. A dispensing snout 70, through which the coffee beans may flow, is attached to the lower end of the container 30. The dispensing snout 70 is designed to be of such a length and diameter that it would be difficult, if not impossible, for one to reach within its interior to tamper with the internal workings of the lower enclosure 60. The container 30 may also have means for diverting the product, such as a diverting tongue 72 attached to the dispensing snout 70.

The cylinder 32 is made of seamless extruded polycarbonate or acrylic plastic generally shaped as a tube. It is important that the cylinder be made of a material that is impervious to the variety of flavorings seen in the increasingly popular gourmet coffee products. For example, the oils used in flavoring gourmet coffees, such as cinnamon, hazelnut, and amaretto flavorings, can tend to cause tiny crevices and cracks to develop over time in the plastics of the coffee bins and associated plastic machinery (a process called crazing). Accordingly, the cylinder 32 may be made of different types of materials such as tempered glass or non-acrylic plastics such acrylonitrile butadiene styrene (ABS) plastics.

The elongated cylinder 32 will normally be from about 4 to about 12 inches in diameter, preferably 8 inches, and from about 10 to about 60 inches in height, preferably 30 to 36 inches. Of course, it can be appreciated that the cylinder 32 can be of any diameter and height, subject to a sufficient vacuum source. The inside of the cylinder is to be somewhat smooth and of uniform diameter and the top and bottom are preferably covered with air-tight enclosures 40 and 60. Alternatively, the storing means may be any air-tight enclosure capable of holding the product to be dispensed, such as a spherical, cylindrical, conical, or rectangular enclosure, and may be made of a variety of materials suitable for the product being stored and the vacuum conditions desired.

Also shown in FIGS. 5 and 6 is a handle or knob 38 which the shopper uses to activate the system. The handle 38 is curved and has several indentions to provide a tactile gripping surface. While its dimensions may vary greatly, preferably the handle is from about 1 to about 3 inches tall and from about ½ to about 2 inches wide, and is located from about ½ to about 1 inch from the exterior of the lower enclosure 60.

An inverted cone (not shown) is attached to the lower enclosure 60 by two stand-offs (not shown) and ascends within the cylinder 32. The inverted cone, with its point up, causes the coffee beans located at the center of the cylinder 32 to be diverted to the sides for even product rotation. As such, the coffee beans first added to the cylinder are first fed into the portion control bin 80 for customer use.

Figure 7A:
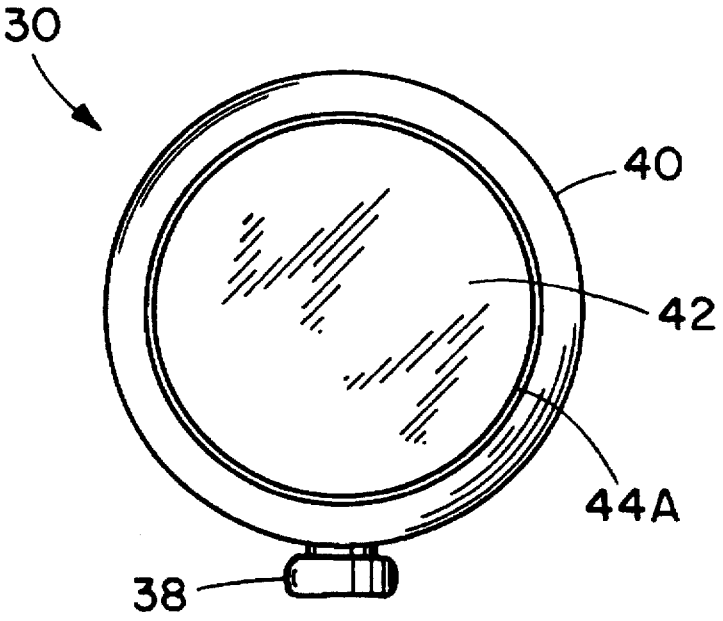
FIG. 7A is a top view of the container depicted in FIG. 5.

Attached to the top end of the cylinder 32 is an upper enclosure 40 having a lid or cap 42 which can be removed so that the coffee beans may be poured into the cylinder. In fact, whole roasted coffee beans that were vacuum-packaged into bags at a coffee roasting plant may be opened and poured into the cylinder at the retail site. The cylinder 32 may be filled completely with coffee beans or to any smaller portion thereof. A flat gasket or O-ring 44A forms a secure seal with the lid 42 and the upper enclosure 40. In the operating or vacuum state, it is apparent that the need for a locking lid has been eliminated since the vacuum locks the lid on automatically. For additional security, however, for example when the vacuum is off, a locking mechanism may lock the lid in place. FIG. 7A is a top view of the container 30 showing the handle 38, upper enclosure 40, lid 42, and O-ring 44A.

Figure 7B:
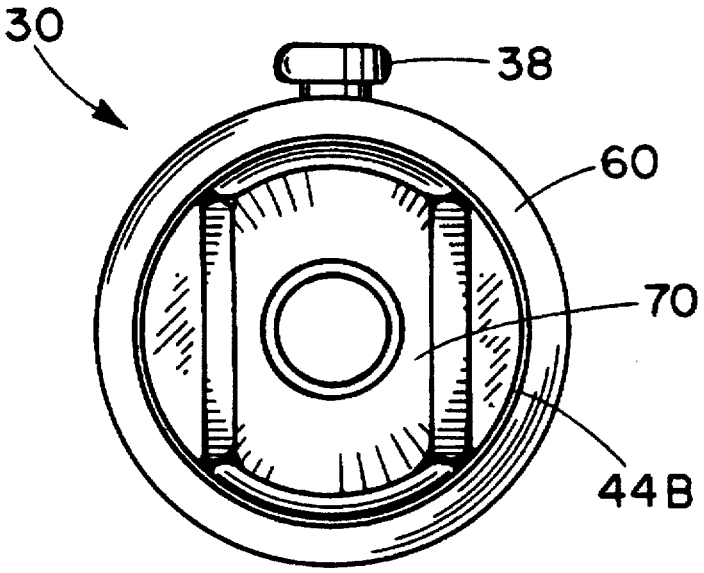
FIG. 7B is a bottom view of the container depicted in FIG. 5.

Attached to the bottom end of the cylinder 32 is a lower enclosure 60 to which the dispensing snout 70 is attached. The dispensing snout 70 can also be attached to the lower chassis plate 180B. If desired, a flat gasket or O-ring 44B can form a secure seal with the dispensing snout 70 and the lower enclosure 60. Both the upper and lower enclosures 40 and 60 are circumscribed by a depending flange 50A and 50B, arranged to fit the top and bottom ends of the cylinder 32. Disposed around the inner circumference of the upper and lower enclosures is a flat gasket or O-ring 64A and 64B, or more preferably, a silicone joint, which in the operative manner, sets upon the edge of the cylinder 32 to form a secure seal. Of course, elastomeric compounds are excellent choices for the seal or gasket material. They store elastic energy, conform to fit surface irregularities, and are resistant to many chemicals. FIG. 7B is a bottom view of the container 30 showing the handle 38, lower enclosure 60, dispensing snout 70, and O-ring 44B.

The upper and lower enclosures 40 and 60 will normally be from about 4 to about 12 inches in diameter, preferably 8 inches, and from about 2 to about 8 inches in height, preferably 5 inches. The upper and lower enclosures taper inward at the ends not connected to the cylinder 32 to a diameter less than the diameter of the cylinder, preferably to about 5 inches. The enclosures are injection molded of plastic material. A vacuum line 90 is shown attached to the rear of the dispensing snout 70 of the container 30 in FIG. 6. As described below in connection with FIG. 8, the vacuum line 90 is connected to an elbow piece 91 found within the dispensing snout 70 and lower enclosure 60. Accordingly, each container 30, and their cylinder 32, in which the perishable items are stored, are in fluid communication with the vacuum system of the present invention.

Figure 8:
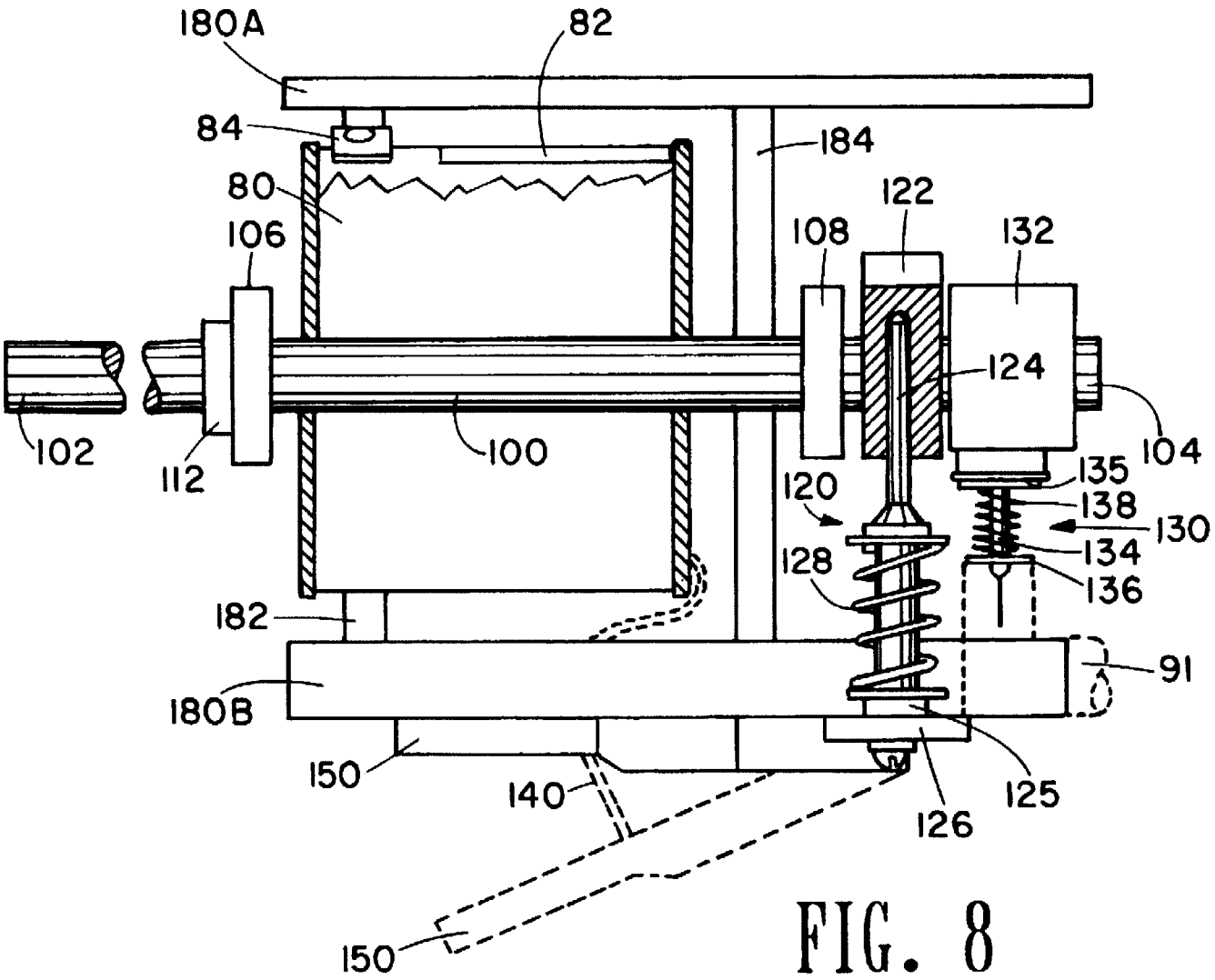
FIG. 8 is a cross-sectional view of a rotary shaft, portion control bin, valves and cams, and dispensing door of an embodiment of the present invention.

FIG. 8 is a cross-sectional view of a shaft, portion control bin, valves and cams, and dispensing door of an embodiment of the present invention. The working parts, to be discussed below, are mounted upon a lower chassis plate 180B having vertical supports 182 and 184, all of which are contained within the lower enclosure 60 of the container 30. Below the elongated cylinder 32 is an upper funnel 180A. As discussed below, the coffee beans held in the cylinder 32 may flow through an opening in the upper funnel 180A into a portion control bin 80. Similarly, below and attached to the lower chassis plate 180B is the dispensing snout 70. As discussed below, coffee beans held in the portion control bin 80 may flow through an opening in the lower chassis plate 180B into the dispensing snout 70.

A major driving element of the merchandising system is a rotary shaft or axle 100. The shaft may be made of aluminum, polycarbonate, fiberglass-filled polycarbonate, stainless steel, or other metals and materials appropriate for the container. The rotary shaft 100 has a diameter from about ¼ to about ½ inch and a length somewhat longer than the diameter of the lower enclosure 60, preferably, about 8 inches.

One end 102 of the shaft is attached to the handle or knob 38, which the shopper uses to activate the system. The other end 104 of the shaft resides within a U-shaped retainer seat or bearing housing (not shown) attached or integrally molded to the inner wall of the lower enclosure 60. The handle may be glued, pop riveted, screwed, bolted, "key wayed," or otherwise connected to the end 102 of the shaft 100.

A collar 112, such as a machined O-ring gasket or cup seal gasket, may be attached or integrally molded to the inner wall of the lower enclosure 60 to provide a seal where the end 102 of the shaft 100 exits the enclosure for the handle. As discussed above, since the shaft 100 is longer than the diameter of the lower enclosure 60, the shaft extends through the lower enclosure to provide an end 102 to which the handle 38 may be connected. Attached to the shaft is a portion control bin or dispensing cup 80, a return helper spring (not shown), a cam lobe 122 to activate a dump valve 120, and a cam lobe 132 to activate a vacuum-line shut off valve 130. The shaft 100 is supported by two in-line beatings 106 and 108 which keep the shaft running "true" or straight. A connecting rod 140, which opens a dispensing door 150, is attached to the side of the portion control bin 80.

The dispensing container also comprises a means, such as a vacuum dump valve, for temporarily eliminating the pressure differential during the removal or restocking of the product from the storing means. The dump valve 120 is a poppet-style valve in the back of the unit. The dump valve has a valve stem 124, valve plate 125, valve seat 126, and return spring 128. The valve stem, valve plate, and valve seat are all one molded piece. The atmosphere is in fluid communication with the valve seat 126. The dump valve is activated by a cam lobe 122 on the main shaft 100. When the container 30 is "closed," the stem 124 of the dump valve is standing straight up. Because the valve plate 125 is "seated" on top of the valve seat 126, no air is allowed into the container 30. As the shopper turns the handle 38, which is attached to the end 102 of the shaft 100, clockwise, the cam lobe 122 pushes the valve stem 124 of the dump valve 120, thereby knocking the valve plate 125 off of the valve seat 126. This "dumps the vacuum" by allowing air to enter the container 30. Without the dump valve, the shopper would not be strong enough to break the vacuum seal of the container. If desired, this feature can be used to prevent theft or unauthorized access to the contents of the storage and dispensing container 30. As such, the dispensing container may further comprise a means for selectively inhibiting the means for removing a portion of the product from the storing means. For example, valve 120 can be blocked from operating until enabled, perhaps as a result of payment for the product. When the main shaft 100 is returned to its closed position, the cam lobe 122 stops pressing on the valve stem 124, and the return spring 128 straightens up the valve stem 124. This reseats the valve plate 125, and prevents additional air from entering the container 30.

The dispensing container also comprises means for creating and maintaining a pressure differential within the storing means. For example, a vacuum-line shut off valve 130 is also built into the bottom of the unit. The vacuum-line shut off valve has a valve stem 134, valve plate 135, valve seat 136, and return spring 138. A vacuum line 90, via elbow piece 91, is in fluid communication with the valve seat 136. The vacuum-line shut off valve is a compression-type valve. When the container 30 is "closed," the valve plate 135 is not "seated" on the valve seat 136. As such, a vacuum may be created within the container 30. As the shaft 100 is turned clockwise, a cam lobe 132 presses the valve plate 135 on top of the valve seat 136, down over the opening to the elbow piece 91. This seals off or shuts off the vacuum line 90 so a vacuum pump 160 does not mm on while the customer is using the unit. When the main shaft 100 is returned to the closed position, the valve plate 135 lifts up off the valve seat 136, opening the vacuum line 90. The pump 160 turns on and the vacuum is recreated.

A return helper spring (not shown) is also attached to the rotary shaft or axle 100. This spring is intended to assist the consumer by helping close the dispensing door 150 and returning the main shaft 100 to the closed position when the consumer has concluded their shopping. A connecting rod or tension cable 140, such as a small steel wire, is connected to the dispensing door 150 on one end and to the portion control bin 80 on the other end. The connecting rod 140 pushes the dispensing door 150 open to allow the coffee beans to exit, and pulls the dispensing door shut as the main shaft 100 is returned to the closed position. In another embodiment, the connecting rod 140 could be replaced by a chain. The dispensing door 150 must shut tightly to form a perfect seal to maintain the vacuum conditions within the cylinder 32. As such, there may be an O-ring seal (not shown) to which the dispensing door 150 abuts when closed. The dispensing door rotates along a pivot point defined by two hinge posts molded to the lower chassis plate 180B.

In general, the removing means of the dispensing container may comprise a means for holding a portion of the product, such as a portion control bin, having a chamber and an opening in fluid communication therewith, and a means for moving the holding means, such as a rotary shaft, from a feeding position, where the product enters the chamber through the opening, to a dispensing position, where the product exits the chamber through the opening. The portion control bin or dispensing cup 80 is a "floating drum" on the main shaft 100 that could be one molded piece or two or more pieces sonic-welded together. Although the portion control bin 80 is depicted as a cylinder or drum, it could also comprise a dispensing cup or cone that is not cylindrical. The portion control bin has a small opening or slit 82, which, when in the closed or feeding position, is closest to the upper funnel 180A and to the bottom of the cylinder 32, such that the whole-bean coffee may fall through the opening in the upper funnel 180A, through the portion control bin opening 82, and into the portion control bin. The portion control bin 80 is designed to hold a certain volume of the perishable item being dispensed, here the bin size will hold approximately ¼ lb. of whole-bean coffee. When the customer rams the handle 38 which is attached to the end 102 of the shaft 100, which in turn is attached to the portion control bin 80, the bin rotates clockwise toward the lower chassis plate 180B and toward the dispensing snout 70. The small opening 82 of the portion control bin 80 will then be directly above the now opened dispensing door 150 to a dispensing position, so that the premeasured amount of perishable item may flow through the opening in the lower chassis plate 180B, through the dispensing snout 70, and into the customer's bag. If desired, the unit can have a "clutch" built into the portion control bin. As such, the main shaft 100 can turn approximately fifteen degrees (15°) before the portion control drum 80 starts turning. However, the valves 120 and 130 can be activated and the dispensing door 150 can begin opening immediately.

A stop 84 is attached to the top of the portion control bin 80 near the opening 82. The stop aligns the opening 82 of the portion control bin 80 with the opening in the upper funnel 180A for the closed position, and aligns the opening 82 with the opening in the lower chassis plate 180B for the opened position. The stop 84 also limits the rotation of the portion control bin 80 to approximately one hundred eighty degrees (180°). In alternative embodiments, the stop 84 may be attached to the side of the portion control bin 80 or on the shaft 100.

In another embodiment, to keep chaff and beans from getting caught between the portion control bin 80 and the upper funnel 180A and lower chassis plate 180B in which it rotates, a series of brushes, such as nylon brushes, can be included to direct the coffee beans into the portion control bin 80. In alternative embodiments, the metered dispensing system described above could be replaced by a spring-loaded swing door or the like wherein the customer controls the amount of product desired.

Figure 9:
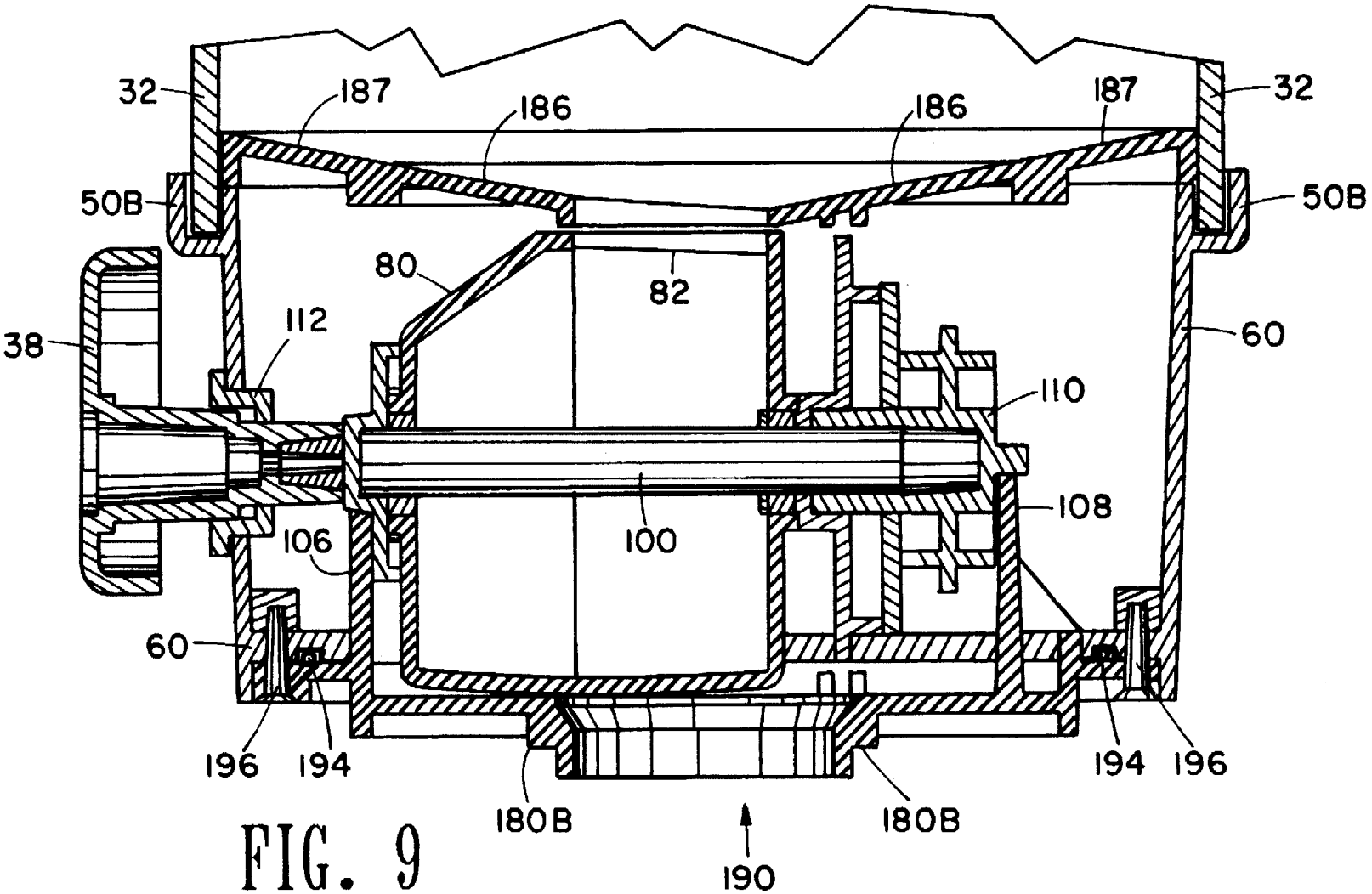
FIG. 9 is a cross-sectional view of a cylinder, lower enclosure, rotary shaft, portion control bin, and lower chassis plate of another embodiment of the present invention.

Turning now to FIG. 9, there is shown a cross-section view of the cylinder 32, lower enclosure 60, rotary shaft 100, portion control bin 80, and lower chassis plate 180B of another embodiment of the present invention. For ease in viewing, the valves, cams, and dispensing door described above have been removed. The cylinder 32 rests within a flange 50B of the lower enclosure 60. The cylinder is attached to the lower enclosure with a silicon joint. The portion control bin 80 with its opening 82 is attached to the rotary shaft 100. Further, there is a top funnel 187 and a directing funnel 186 near the top of the lower enclosure 60 for facilitating directing of the perishable items held within the cylinder 32, such as coffee beans, into the small opening 82 of the portion control bin 80.

The rotary shaft 100 is supported by bearings 106 and 108, which are a part of the lower chassis plate 180B. The lower chassis plate 180B has an opening or discharge port 190 through which the perishable items may exit the lower enclosure 60. An O-ring 194 forms a seal between the lower chassis plate 180B and the lower enclosure 60, which are held together by a plurality of flat head screws 196.

Several of the components of the storage and dispensing container 30 may be removed and disassembled for routine maintenance. With the vacuum conditions released, the dispensing snout 70 and dispensing door 150 can be removed from the lower enclosure 60. Similarly, the handle 38 can be removed from the shaft 100. The screws 196 can be unscrewed from the lower chassis plate 180B. The lower chassis plate, rotary shaft, portion control bin, valves and cams can then be slid out from the bottom of the lower enclosure.

In another embodiment, the cylinder 32 and lower enclosure 60 could have multiple chambers such that a metered amount of coffee beans could be transferred from a top chamber to a bottom chamber, from which it could then be dispensed. The top and bottom chambers could be maintained through the same or separate vacuum lines. In this embodiment, only a portion of the coffee beans are "at risk" of being exposed to oxygen thereby circumventing the malicious customer who succeeds in temporarily propping the dispensing door 150, with a stick or other article, in the open position.

Figure 10:
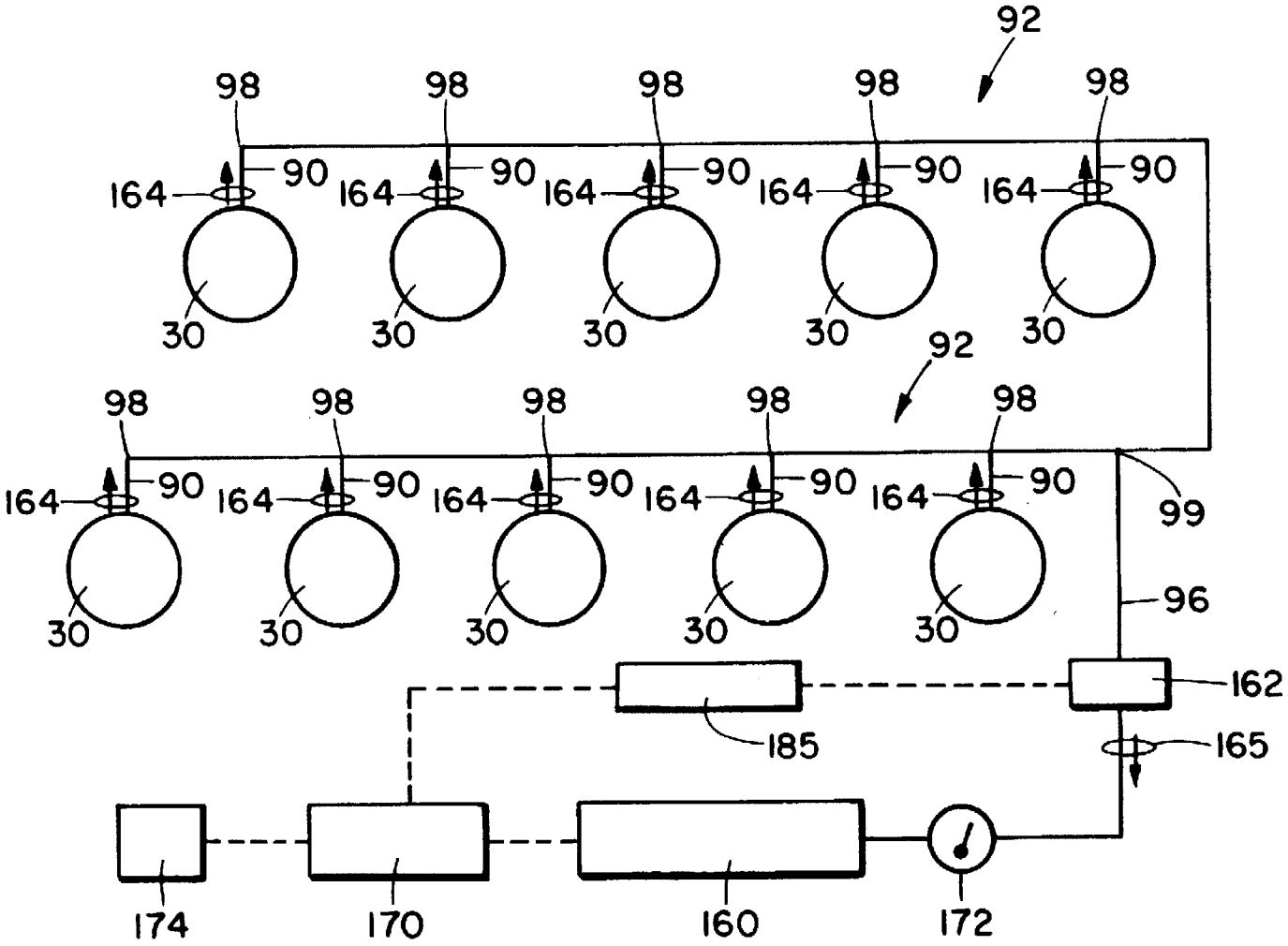
FIG. 10 is a schematic block diagram of a vacuum system of the present invention.

Turning now to FIG. 10, there is shown a schematic block diagram of the vacuum system of the present invention. A vacuum line 90 is connected to the back of each container 30. To prevent cross-contamination of coffee flavors or aromas, there is one in-line check valve 164 per container. The check valves 164 are one-way valves which do not let air into the containers 30 from the vacuum lines. The vacuum lines 90 from the front row of the 5 containers are joined together with T-connectors 98 to form one vacuum line 92. Similarly, the vacuum lines 90 from the back row of the 5 containers are joined together with T-connectors 98 to form one vacuum line 94. Then, the from row vacuum line 92 and the back row vacuum line 94 are joined together with a T-connector 99 to form one vacuum line 96, which is in fluid communication with the vacuum pump 160. The front vacuum lines are "hidden" within a manifold (not shown) and are branched out to each individual container 30. The rear vacuum lines are "hidden" behind the rear wall 11C of the merchandising unit 10. As seen in FIG. 4, the vacuum lines converge at the back of the merchandising unit 10 to form one vacuum line 96 which is connected to a vacuum pump 160. For convenience, the vacuum lines may be secured to the rear wall 11C with fasteners. There is also a one-way check valve 165 positioned between a pressure switch 162 and the vacuum pump 160, to further maintain the vacuum.

The vacuum pump 160 can be any reciprocating or rotary pump suitable for creating a vacuum in the container 30. For example, the vacuum pump may be an oil-based reciprocating piston pump which may be turned on to recreate the vacuum. More preferably, a diaphragm pump will be used to create the vacuum. In general, the dispensing container may further comprise a means for detecting and recreating the pressure differential within the storing means. For example, the vacuum pump 160 is connected to a pressure switch 162 that triggers the "turning off" or "turning on" of the vacuum pump 160. When the pressure switch 162 senses either a lack of vacuum or insufficient vacuum in the vacuum line 96, it actuates a switch, thereby sending a signal that closes the solenoid 185 bleed valve and activates the vacuum motor 170. The motor starts, turning the vacuum pump 160, which recreates the vacuum in the system. When the vacuum in the system reaches a preset level, the pressure switch 162 sends a signal that opens the solenoid 185 bleed valve, deactivates the motor 170, and turns off the vacuum pump 160.

It may be desired to measure and display the changes in the pressure of the air with a mechanical pressure gauge 172. The simplest mechanical gauges that can be used are the diaphragm gauge, Bourdon gauge, and capacitance manometer. Of course, a variety of direct and indirect gauges may be used to measure the reduced pressures of the particular vacuum system being used. The vacuum or pressure differential created within the storing means, measured between the pressure inside the storing means and the pressure outside the storing means, should be in the range of from above 0 inches of mercury (Hg) column to about 30 inches of mercury (Hg) column, and preferably about 10 to 13 inches of mercury (Hg) column. The vacuum pump 160, display gauge 172, motor 170, pressure switch 162, and solenoid 185 are hidden from view, enclosed within the compartment 17 of the utility cabinet 20. If desired, the compartment 17 may be covered or lined with noise-reducing materials. Typically, the vacuum motor 170 and the vacuum pump 160 are both contained within one unit. It is contemplated that the vacuum pump 160 may be varied in intensity according to the desires of the container owner, and like the switch 162, can be purchased as an off-the-shelf item. The alternating current (A/C) source 174 is standard electric current through a power strip.

In another aspect of this invention, there is provided a consumer interactive component 22, which can be attached on or within the door of compartment 17, that aids the consumer in his or her selection of coffee beans. In one embodiment, the consumer interactive component 22 comprises a screen with touch pads or push buttons and selective dialogue, similar to the components of a typical automated teller machine. In another embodiment, the component 22 could also include a digital voice device which can provide a short, educationally descriptive, recording concerning the particular coffee bean or coffee blend selected, be it flavored coffees, unblended varietals, or blended varietals.

In the use of this invention, the lid or cap 42 on the upper enclosure 40 is removed and the perishable item is poured into the cylinder 32. The lid 42 is replaced and the cylinder is then maintained under a vacuum by pump 160 which is connected to the cylinder by vacuum lines 90, 92 or 94, and 96. After selecting the particular perishable item desired, the consumer turns a knob 38 which opens the dispensing door 150. This knob, which is attached to the rotary shaft 100, causes the shaft to rotate, and thus turning the cam lobe 122. The cam lobe moves the dump valve 120, which opens the vacuum, allowing air to enter the cylinder 32, and allowing the vacuum to be released. The perishable item, such as coffee beans, flow out through the dispensing snout 70 into the customer's bag. With the assistance of a helper spring 114, the rotary shaft 100 and dispensing door 150 are then returned to a closed position. A pressure switch 162 notes the lack of vacuum and triggers the vacuum pump 160 such that the vacuum conditions are recreated to maintain the freshness of the perishable item. With this construction, a vacuum is maintained so that no outside air can come in contact with the perishable item so as to cause its deterioration and no foreign matter can come in contact with the perishable item.

While the device has been described particularly for use with roasted whole-bean coffee, it is evident that the vacuum storage and dispensing container could be used for a variety of food products or perishable items where extended shelf life is desirable. As such, the invention is capable of broad application and is readily adaptable to other fields, uses, and applications. Also note that some situations may require an increase of pressure, and in such a situation, the principles of this invention can be used.

Although the present invention and its advantages have been described in detail, it should be understood that various changes, substitutions and alterations can be made herein without departing from the spirit and scope of the invention as defined by the appended claims.

What is claimed is:

1. A storage and dispensing container, comprising:

means for storing product to be dispensed, said storing means having a top end and a bottom end;

an upper enclosure attached to said top end of said storing means;

a lower enclosure attached to said bottom end of said storing means; wherein said lower enclosure further comprises:

a lower chassis plate, said lower chassis plate being mounted within the lower enclosure;

a collar intergrally molded to an inner wall of the lower enclosure;

a bearing housing integrally molded to the inner wall of the lower enclosure;

a rotary shaft, said shaft having a first end and a second end, said first end extending through said collar, said second end residing within said bearing housing;

a handle attached to said first end of said shaft;

a portion control bin attached to said shaft, said portion control bin having a opening;

a dump valve cam lobe attached to said shaft, said cam lobe activating a dump valve; and a vacuum-line shut off valve cam lobe attached to said shaft, said cam lobe activating a vacuum-line shut off valve;

means for releasing and creating a vacuum in said storing means, said upper enclosure, and said lower enclosure; and means for removing said product form said storing means.

* * * * *